US010333249B1

(12) United States Patent
Wang

(10) Patent No.: US 10,333,249 B1
(45) Date of Patent: Jun. 25, 2019

(54) ELECTRONIC CONNECTOR WITH MAGNETIC ELEMENT AND DATA TRANSMISSION LINE USING SAME

(71) Applicant: Shenzhen Tongyinhai Precision Electronics Co., Ltd, Shenzhen, Guangdong (CN)

(72) Inventor: Yinyin Wang, Guangdong (CN)

( * ) Notice: Subject to any disclaimer, the term of this patent is extended or adjusted under 35 U.S.C. 154(b) by 0 days.

(21) Appl. No.: 16/242,002

(22) Filed: Jan. 8, 2019

(30) Foreign Application Priority Data

Aug. 2, 2018 (CN) ..... 2018 2 1243859 U
Aug. 2, 2018 (CN) ..... 2018 2 1255953 U

(51) Int. Cl.
*H01R 13/62* (2006.01)
*H01R 24/62* (2011.01)
*H01R 31/06* (2006.01)
*H01R 11/30* (2006.01)

(52) U.S. Cl.
CPC ..... *H01R 13/6205* (2013.01); *H01R 11/30* (2013.01); *H01R 24/62* (2013.01); *H01R 31/065* (2013.01)

(58) Field of Classification Search
CPC ..... H01R 11/30; H01R 13/6205
See application file for complete search history.

(56) References Cited

U.S. PATENT DOCUMENTS 9,362,664 B2 * 6/2016 Yen ..... H01R 13/6205
9,515,420 B2 * 12/2016 Daoura ..... H01R 13/6205
9,515,442 B2 * 12/2016 Cymerman ..... H01R 31/06
9,979,138 B1 * 5/2018 Chen ..... H01R 13/7137
9,991,628 B2 * 6/2018 Daoura ..... H01R 13/6205
9,991,657 B2 * 6/2018 Powers ..... H01R 31/06
10,069,265 B2 * 9/2018 Wu ..... H01R 31/06
10,096,932 B2 * 10/2018 Chang ..... H01R 13/74
2010/0144164 A1 * 6/2010 Wang ..... H01R 13/6205 439/39
2013/0189855 A1 * 7/2013 Lai ..... H01R 13/625 439/39
2015/0081944 A1 * 3/2015 An ..... H01R 13/6205 710/300
2015/0118868 A1 * 4/2015 Choi ..... H01R 11/30 439/39
2015/0244105 A1 * 8/2015 Peng ..... H01R 13/6205 439/39

(Continued)

*Primary Examiner* — Ross N Gushi
(74) *Attorney, Agent, or Firm* — Jie Yang; Zan IP LLC

(57) ABSTRACT

An electronic connector is disclosed in the present disclosure. The electronic connector includes: a male connector; a female connector comprising: a shell; a supporting element received in the shell, and including an insertion opening and a receptacle space communicated with the insertion opening; a magnetic element received in the shell and surrounding the supporting element; a first terminal assembly and a second terminal assembly corresponding to the first terminal assembly received in the supporting element, wherein, the first terminal assembly including a plurality of first terminals, and the second terminal assembly including a plurality of second terminals, each of the first terminal extending into the receptacle space, and each of the second terminal extending into the receptacle space, and the first terminal and the corresponding second terminal forming a clamp for clamping the male connector which is inserted into receptacle space via the insertion opening.

17 Claims, 8 Drawing Sheets

(56) References Cited

U.S. PATENT DOCUMENTS

| | | | | |
|---|---|---|---|---|
| 2015/0288118 | A1* | 10/2015 | Michelmann | H01R 13/502 439/38 |
| 2015/0364860 | A1* | 12/2015 | Cheng | H01R 13/60 439/40 |
| 2016/0211609 | A1* | 7/2016 | Sorias | H01R 13/6205 |
| 2017/0085045 | A1* | 3/2017 | Cymerman | H01R 13/64 |
| 2018/0013231 | A1* | 1/2018 | DiFonzo | H01R 13/6205 |
| 2018/0294596 | A1* | 10/2018 | Zhang | H01R 13/24 |
| 2018/0331468 | A1* | 11/2018 | Little | H01R 13/6205 |
| 2018/0375251 | A1* | 12/2018 | Wrisley | H01R 13/6205 |
| 2018/0375271 | A1* | 12/2018 | Powers | H01R 31/06 |
| 2019/0027861 | A1* | 1/2019 | Brown | H01F 1/0317 |

* cited by examiner

ELECTRONIC CONNECTOR WITH MAGNETIC ELEMENT AND DATA TRANSMISSION LINE USING SAME

CROSS REFERENCE TO RELATED APPLICATIONS

This application claims the benefit of Chinese Application No. 201821255953.2, filed on Aug. 2, 2018, entitled "Magnetic data cable", and Chinese Application No. 201821243859.5, filed on Aug. 2, 2018, entitled "Android Micro connector", the contents of all of which are incorporated by reference herein in their entirety for all purposes.

TECHNICAL FIELD

The present disclosure relates to an electronic connector, and more particularly to a electronic connector with magnetic element and a data transmission line using such electronic connector.

BACKGROUND ART

The data transmission line used to connect existing electronic product, such as mobile phone, IPAD, and etc., generally includes a line main body and electronic connectors that are respectively provided at both ends of the line main body. When the data transmission line is used, the electronic connector of the data transmission line is frequently inserted into or removed from an interface of the mobile phone and other electronic product, such as the IPAD, repeatedly. After a long period of use, it is often easy to cause loose connections and poor contact between the electronic connector and the interface of the electronic product. In addition, at present, the electronic connector of the data transmission line can only be inserted into the interface of the electronic product in one position, and the reverse insertion cannot be realized, which brings inconvenience to the user.

SUMMARY

In one aspect of the disclosure, an electronic connector comprises: a male connector; a female connector comprising: a shell; a supporting element received in the shell, and including an insertion opening and a receptacle space communicated with the insertion opening; a magnetic element received in the shell and surrounding the supporting element; a first terminal assembly and a second terminal assembly corresponding to the first terminal assembly received in the supporting element, wherein, the first terminal assembly including a plurality of first terminals, and the second terminal assembly including a plurality of second terminals, each of the first terminal extending into the receptacle space, and each of the second terminal extending into the receptacle space, and the first terminal and the corresponding second terminal forming a clamp for clamping the male connector which is inserted into receptacle space via the insertion opening.

In another aspect of the disclosure, an data transmission line comprises a second electronic connector; a first electronic connector comprising: a male connector; a female connector comprising: a shell; a supporting element received in the shell, and including an insertion opening and a receptacle space communicated with the insertion opening; a magnetic element received in the shell and surrounding the supporting element; a first terminal assembly and a second terminal assembly corresponding to the first terminal assembly received in the supporting element, wherein, the first terminal assembly including a plurality of first terminals, and the second terminal assembly including a plurality of second terminals, each of the first terminal extending into the receptacle space, and each of the second terminal extending into the receptacle space, and the first terminal and the corresponding second terminal forming a clamp for clamping the male connector which is inserted into receptacle space via the insertion opening.

BRIEF DESCRIPTION OF THE DRAWINGS

The above and/or additional objects, features and advantages of the present disclosure, will be further elucidated by the following illustrative and non-limiting detailed description of embodiment of the present disclosure, with reference to the appended drawings, wherein.

DESCRIPTION OF THE PREFERRED EMBODIMENT

The present invention will be further illustrated below with reference to the attached drawings and the embodiment.

Figure 1:
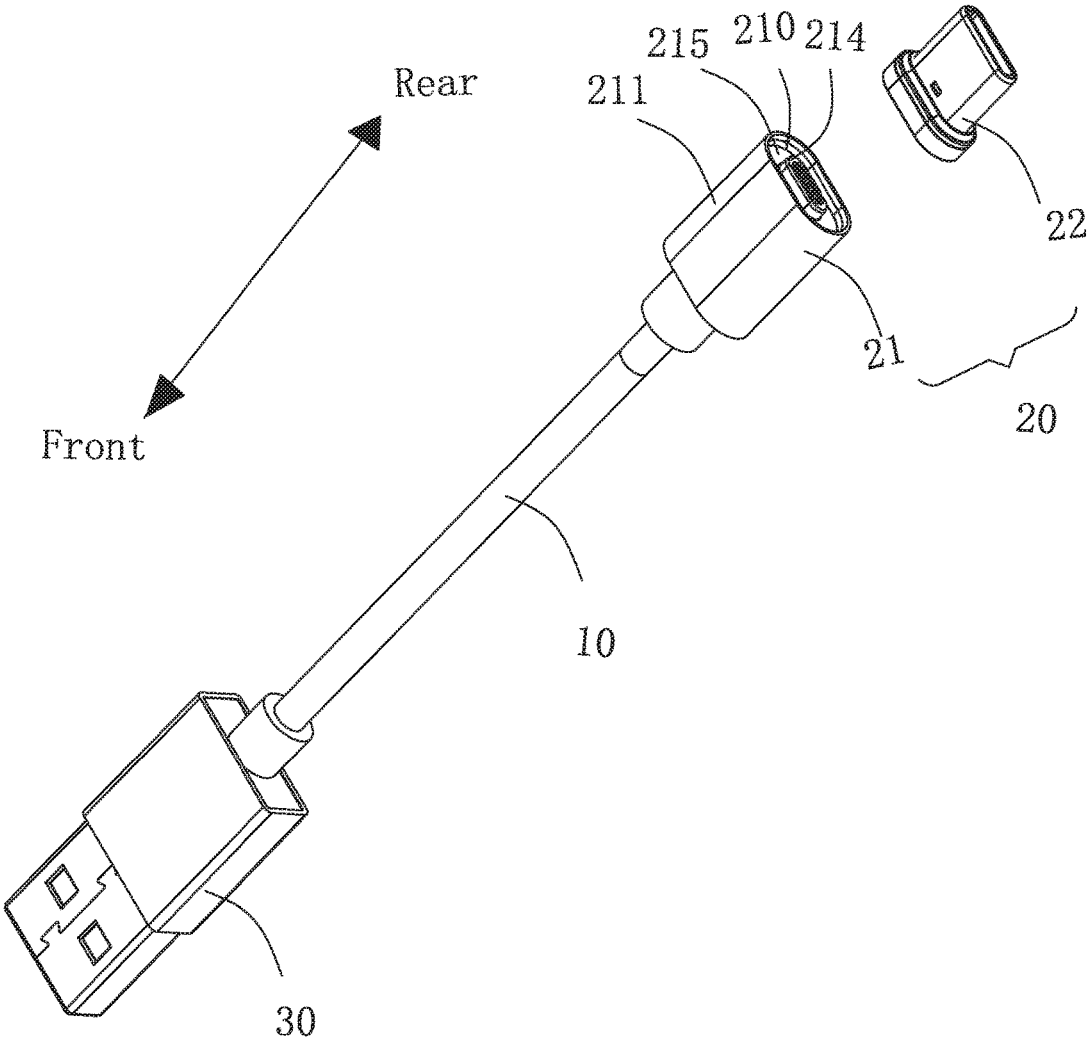
FIG. 1 is a perspective view of a data transmission line according to an embodiment of the present disclosure.
Figure 2:
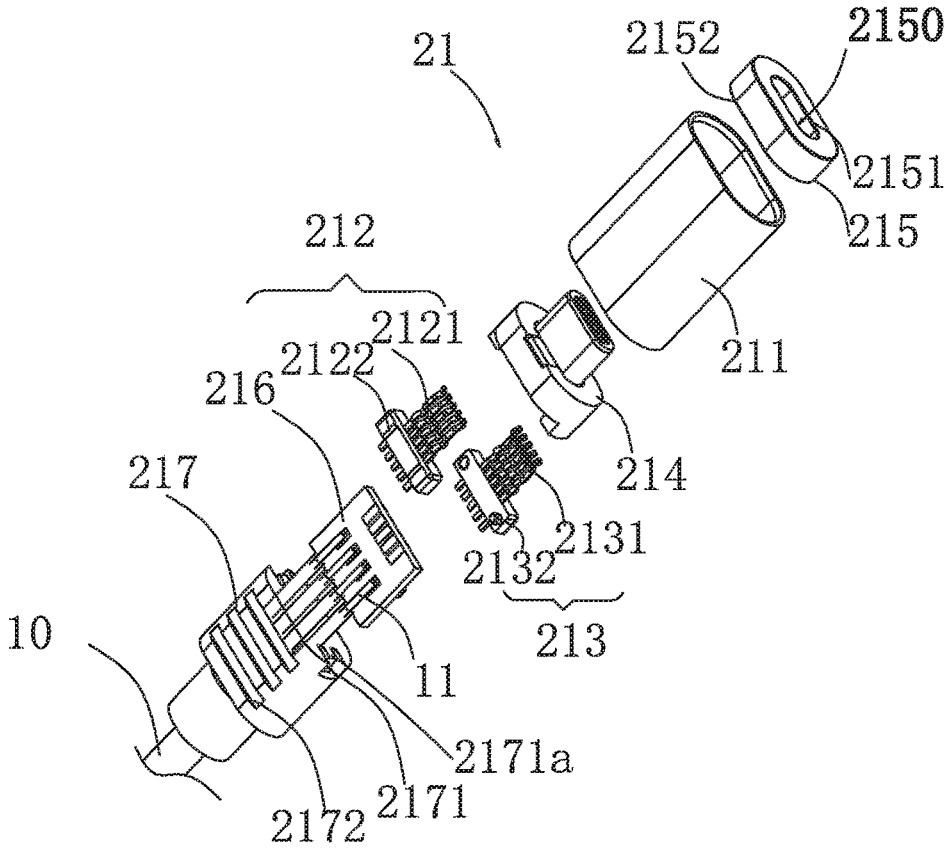
FIG. 2 shows an exploded view of the female connector shown in FIG. 1.
Figure 3:
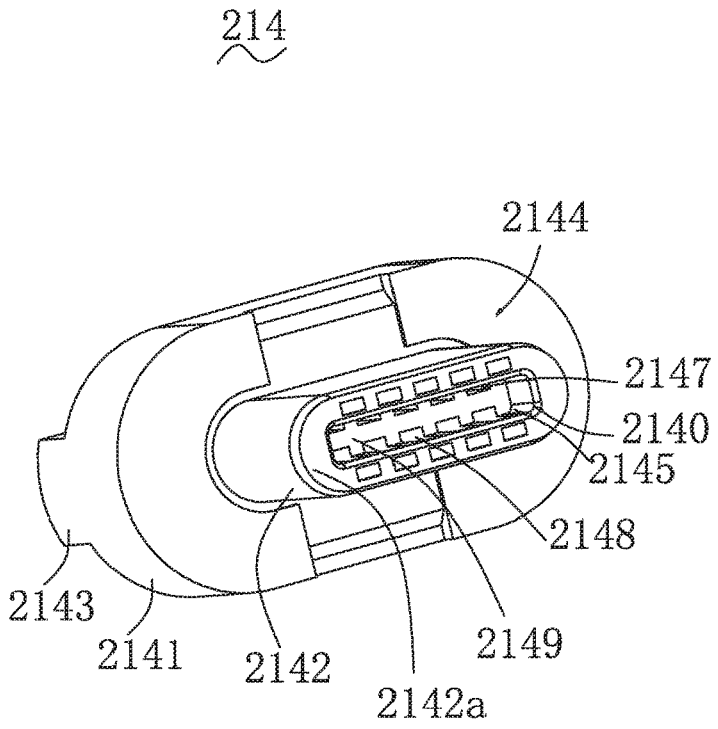
FIG. 3 and FIG. 4 show perspective view of the supporting element of the female connector shown in FIG. 2.
Figure 4:
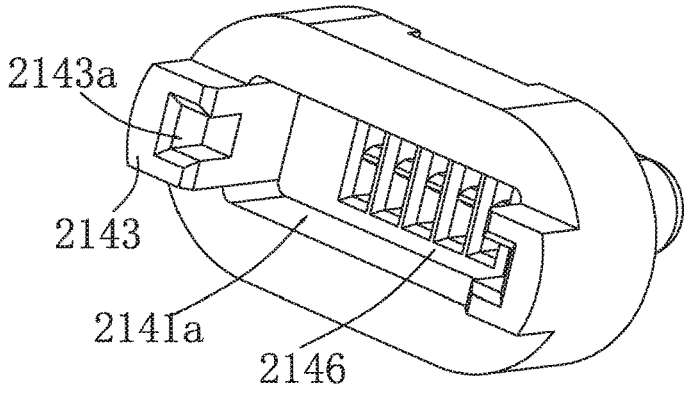
Figure 5:
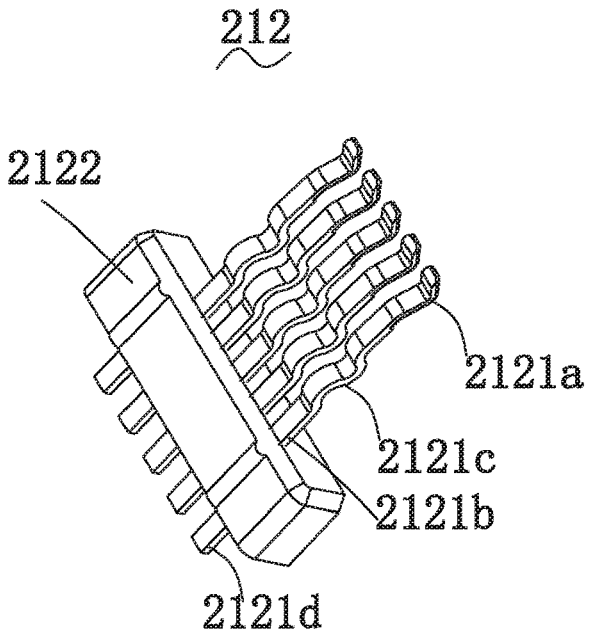
FIG. 5 shows a perspective view of the first terminal assembly of the female connector shown in FIG. 2.
Figure 6:
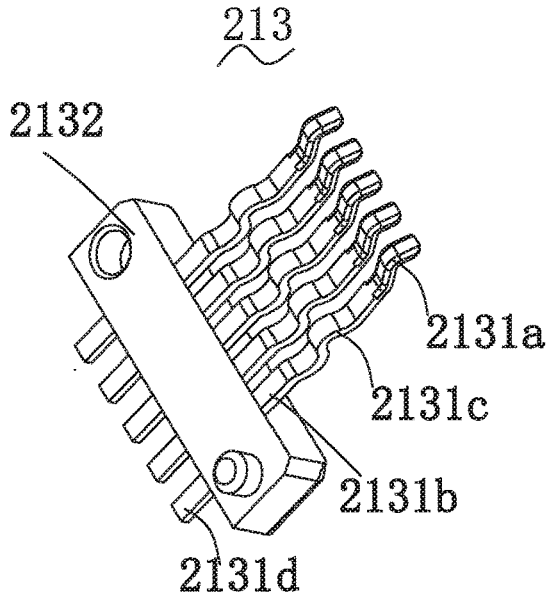
FIG. 6 shows a perspective view of the second terminal assembly of the female connector shown in FIG. 2.
Figure 7:
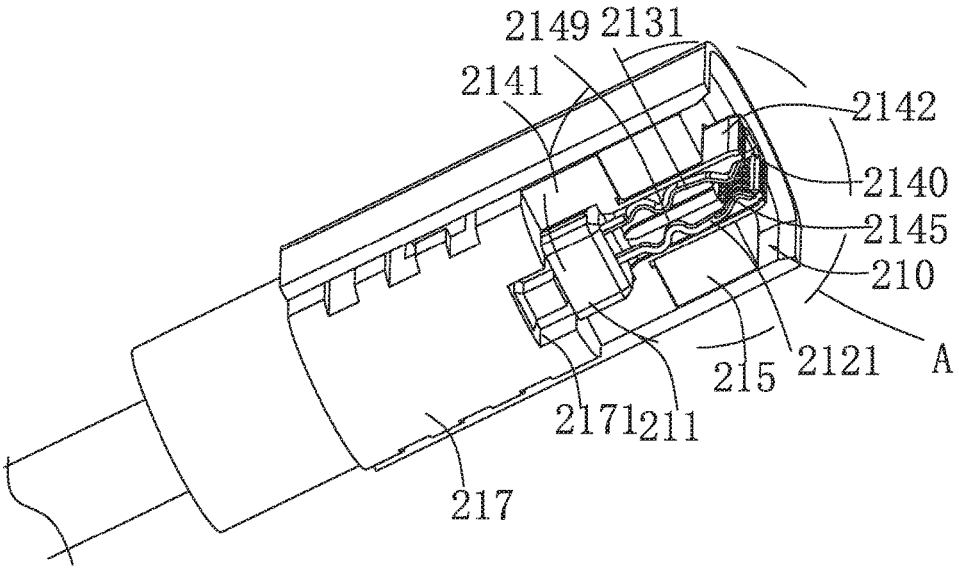
FIG. 7 shows a cross-sectional view of the female connector shown in FIG. 1.
Figure 8:
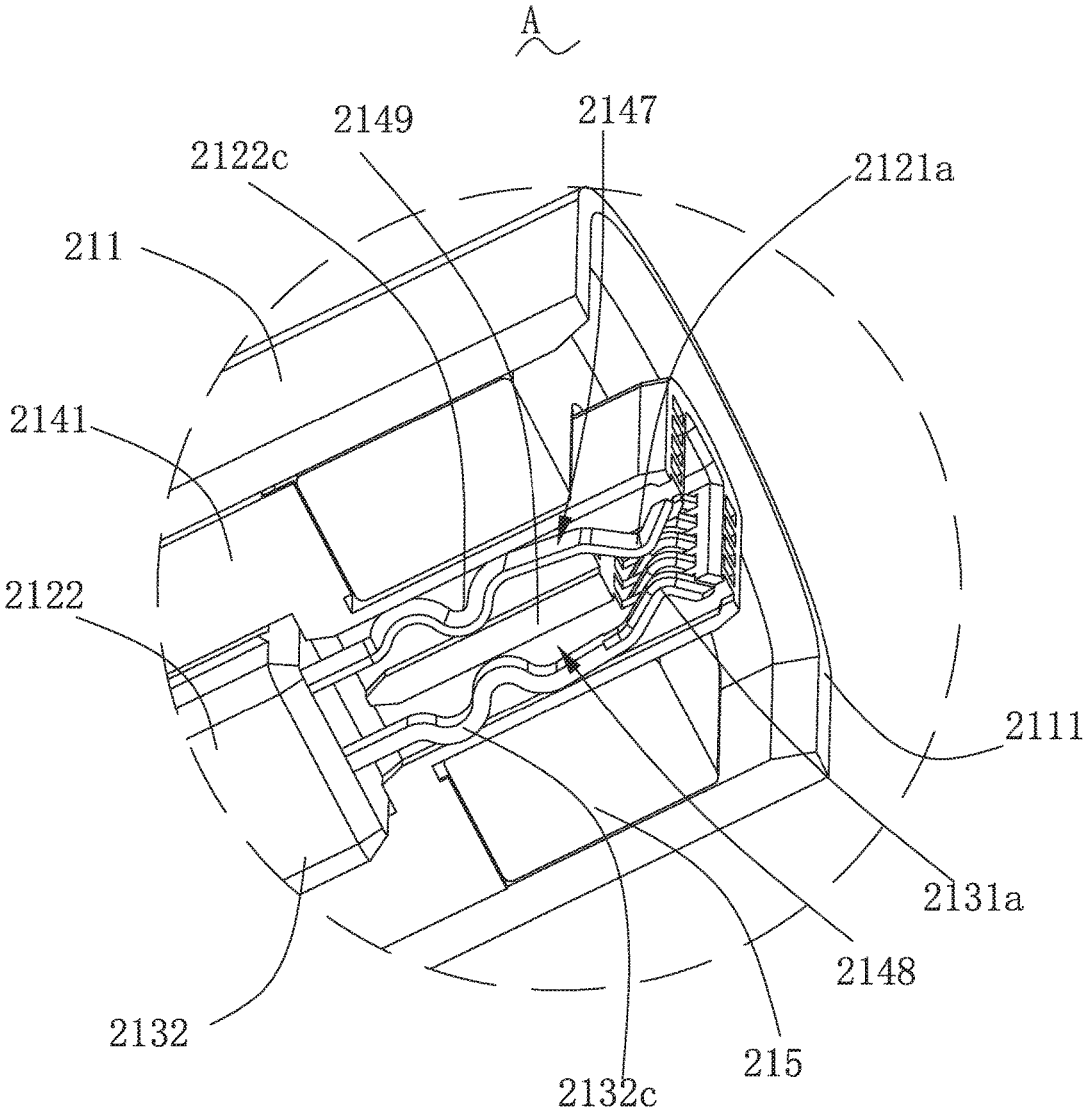
FIG. 8 is an enlarged view of part A in FIG. 7.
Figure 9:
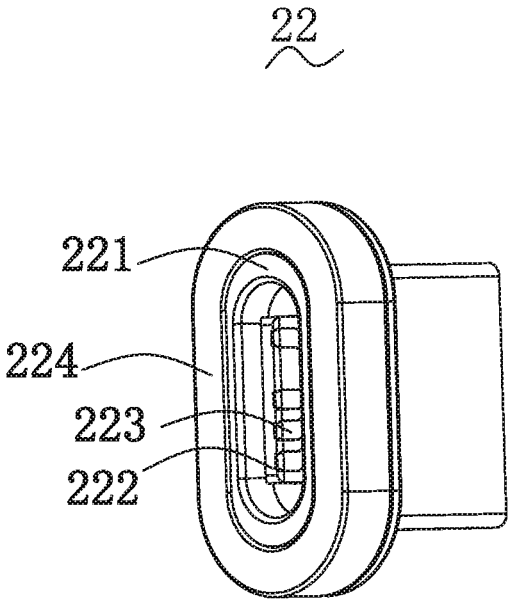
FIG. 9 and FIG. 10 show a male connector of the data transmission line according to the embodiment of the present disclosure.
Figure 10:
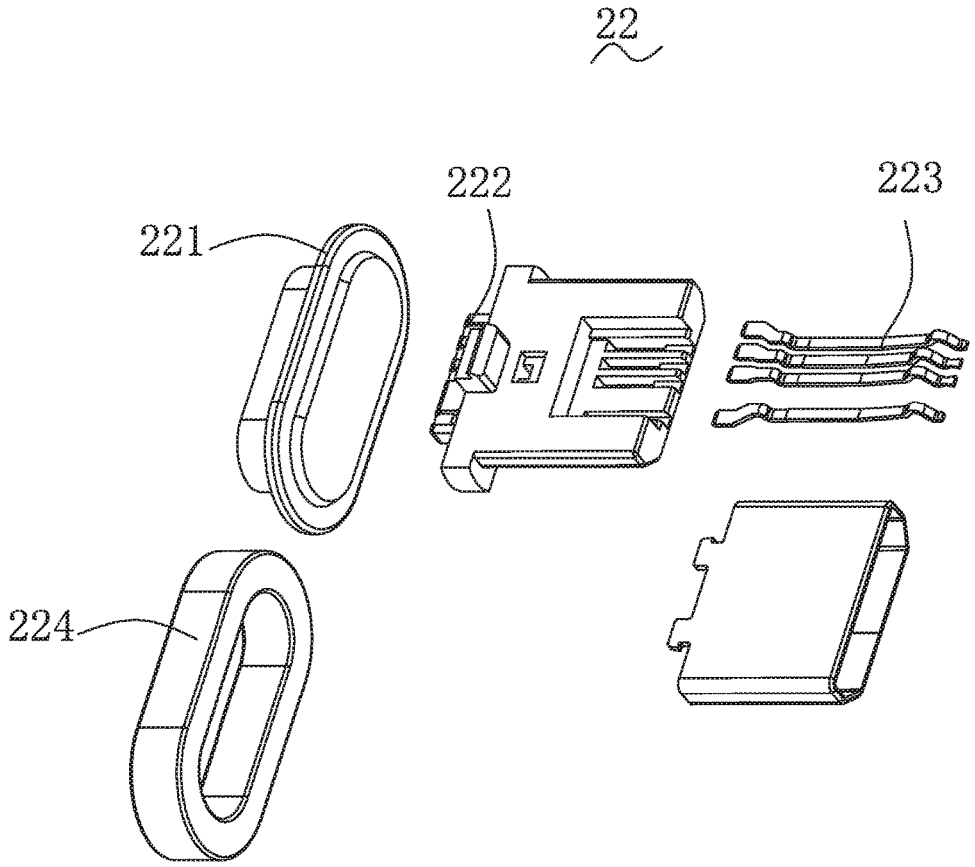

As shown in FIG. 1 through FIG. 10, a data transmission line 100 according to the embodiment includes a first electronic connector 20, a second electronic connector 30 and a cable 10 connected between the first electronic connector 20 and the second electronic connector 30. In this embodiment, the second electronic connector 30 may be an USB interface used for connecting with the interface of an electronic product, such as mobile phone, IPAD, laptop, and etc, or power supply adapter. The first electronic connector 20 may also be an interface used for connecting with the interface of other electronic product. The data transmission line 100 is used for data transmission between two electronic products that are connected via such data transmission line 100, or used to charge the electronic product.

In the embodiment, the term "front" means a forward direction toward the second connector 30, and the term "rear" means a rearward direction toward the first connector. This definition of the term is configured to help to understand the present invention instead of limiting the scope of the application.

The first connector 20 includes a female connector 21 and a male connector 22. When the first connector 20 is used, the male connector 22 is inserted into the female connector 21, with such configuration, the male connector 22 and the female connector 21 are electronically connected. The male connector 22 may be a micro USB connector, a type-C connector, or other conventional connectors. The male connector 22 are removable connected to the female connector 21. The male connector 22 may includes a first connecting assembly for connecting with the female connector 21 and electrically connected with the female connector 21. Specifically, the first connecting assembly includes a hollow housing 221, an insulating part 222 received in the housing 221, a plurality of terminals 223 carried by the insulating part 222 for electrically connecting with the female connector 21, and a magnetic element 224 surrounding the housing 221 for connecting with the female connector 21 by means of magnetic attractive.

The female connector 21 includes a hollow shell 211, a first terminal assembly 212, a second terminal assembly 213, a supporting element 214 for supporting the first terminal assembly 212 and the second terminal assembly 213, and a magnetic element 215. The first terminal assembly 212, the second terminal assembly 213, the supporting element 214 and the magnetic element 215 are received in the hollow shell 211. Preferably, the hollow shell 211 has substantially elliptical column shape and may be made of metallic material. The supporting element 214 may be made of insulate material.

The supporting element 214 is received in the hollow shell 211 and has a T shape. The supporting element 214 includes a base body 2141, a first extending part 2142 extending from the base body 2141 and a pair of second extending parts 2143 extending from the base body 2141 in a direction away from the first extending part 2142. A step portion 2144 is formed between the base body 2141 and the first extending part 2142, as the thickness of the first extending part 2142 is lower than that of the base body 2141. The base body 2141 defines an accommodating space 2141*a*. The second extending part 2143 has a first position groove 2143*a*.

The first extending part 2142 has an insertion opening 2140 and a receptacle space 2145 communicated with the insertion opening 2140. The first extending part 2142 further includes an inner part 2146 located before the receptacle space 2145. The inner part 2146 has a plurality of first terminal grooves 2147 communicated with the receptacle space 2145, a plurality of second terminal grooves 2148 communicated with the receptacle space 2145 and an insulate plate 2149 configured to separate the first terminal groove 2147 and the second terminal groove 2148. The first terminal groove 2147 is close to the upper side of the first extending part 2142, and the second terminal groove 2148 is close to lower side of the first extending part 2142. The first terminal grooves 2147 correspond to the second terminal grooves 2148 one by one. The first terminal grooves 2147 and the second terminal grooves 2148 communicate the accommodating space 2141*a* to the receptacle space 2145.

The first terminal assembly 212 includes a plurality of first terminals 2121 and a first combining block 2122 assembled with the first terminals 2121. Each of the first terminal 2121 includes a first contact portion 2121*a*, a first fixing portion 2121*b* assembled with the first combining block 2122, a first connecting portion 2121*c* connected between the first contact portion 2121*a* and the first fixing portion 2121*b*, and a first extending portion 2121*d* extending from the first fixing portion 2121*b* in a direction away from the first contact portion 2121*a*. The first contact portion 2121*a* has a curved profile. The first connecting portion 2121*c* also has a wavy shaped profile. Each of the first terminal 2121 may be made of elastic electric conducting material. The first combining block 2122 may be made of plastic material.

The second terminal assembly 213 includes a plurality of second terminals 2131 and a second combining block 2132 assembled with the first terminals 2131. Each of the second terminal 2131 includes a second contact portion 2131*a*, a second fixing portion 2131*b* assembled with the second combining block 2132, a second connecting portion 2131*c* connected between the second contact portion 2131*a* and the second fixing portion 2131*b*, and a second extending portion 2131*d* extending from the second fixing portion 2131*b* in a direction away from the second contact portion 2131*a*. The second contact portion 2131*a* has a curved profile. The second connecting portion 2131*c* also has a wavy shaped profile. Each of the second terminal 2131 may be made of elastic electric conducting material. The second combining block 2132 may be made of plastic material.

The magnetic element 215 may be a permanent magnet or an electromagnet. The magnetic element 215 is substantially oval shaped and has a through hole 2150 formed in the center thereof.

When assembled, the first combing block 2122 is assembled with the second combing block 2132 so that the first terminal assembly 212 is connected with the second terminal assembly 213. Then, the first combing block 2122 and the second combing block 2132 are mounted into the accommodating space 2141*a* of the base body 2141; the first terminals 2121 and the second terminals 2131 are received in the first terminal grooves 2147 and the second terminal grooves 2148 respectively, and the first contact portions 2121*a* of the first terminals 2121 and the second contact portions 2131*a* of the second terminals 2131 extend into the receptacle space 2145 to form a clamp for clamping the male connector 22 which inserted into the receptacle space 2145 via the insertion opening 2140. The first contact portions 2121*a* correspond to the second contact portions 2131*a*, and the first contact portions 2121*a* have a curved profile that may be curved inward, and the corresponding second contact portions 2131*a* also have a curved portion that may be curved outward. The first connection portion 2121*c* have a wavy shape and the corresponding second connection portion 2131*c* also have a wavy shape which protrudes in a opposite direction, thus, the first connecting portion 2121*c* and the second connection portion 2131*c* form a clamp for clamping the insulate plate 2149. A rear end surface 2111 of the shell is flush with the rear end surface 2142*a* of the first extending part 2142.

The first extending part 2141 pass through the through hole 2150 of the magnetic element 215, and the magnetic element 215 are mounted on the step portion 2144. The magnetic element 215 surrounds the outside of the support element 214 and received in the shell 211. A front end surface 2152 of the magnetic element 215 abuts against the base body 2141, and a rear end surface 2151 of the magnetic element 215 is more closer to the base body 2141 than the rear end surface 2142*a* of the first extending part 2142 so that a receiving groove 210 is formed by the magnetic element 215 incorporated with the shell 211 and the first extending part 2142. The receiving groove 210 is configured for receiving a part of the male connector 22 while the male connector 22 inserted into the female connector 21.

The female connector 21 further includes a PCB 216 received in the shell 211. The first extending portions 2121*d* of the first terminals 2121 and the second extending portions 2131*d* of the second terminals 2131 are connected with such PCB 216 respectively for data transmission.

The female connector 21 further includes a fixing element 217 for connecting the cable 10 to the first electronic connector 20. Specifically, the fixing element 217 is configured for holding wires 11 of the cable 10. The wires 11 are connected with the PCB 216. The fixing element 217 has a pair of second position grooves 2171 formed in a rearward surface thereof for receiving the second extending part 2143 of the support element 214. Specifically, a protruding part 2171*a* is formed in the position groove 2171, which is received in the first position groove 2143*a* while the second extending part 2143 inserted into the second position groove 2171.

The description in more detail aims to help to understand the present invention, instead of limiting the present invention. According to the contents disclosed by the present invention, those skilled in the art shall understand that the present invention can be implemented even without some or all of these specific details. Under other circumstances, to avoid weakening the inventiveness of the present invention, the well-known circuits, methods, operation processes and the like will not be described in detail.

What is claimed is:

1. An electronic connector, comprising:

a male connector;

a female connector comprising:

a shell;

a supporting element received in the shell, and including an insertion opening and a receptacle space communicated with the insertion opening;

a magnetic element received in the shell and surrounding the supporting element;

a first terminal assembly and a second terminal assembly corresponding to the first terminal assembly received in the supporting element, wherein, the first terminal assembly including a plurality of first terminals, and the second terminal assembly including a plurality of second terminals, each of the first terminal extending into the receptacle space, and each of the second terminal extending into the receptacle space, and the first terminal and the corresponding second terminal forming a clamp for clamping the male connector which is inserted into receptacle space via the insertion opening.

2. The electronic connector of claim 1, wherein, the female connector further comprise a PCB, the PCB is connected to the first terminals and the second terminals, and the PCB is received in the shell.

3. The electronic connector of claim 1, wherein, the supporting element comprises a base body and a first extending part extending from the base body; the insertion opening is defined in a rear end surface of the first extending part and the receptacle space is defined in an inner of the first extending part.

4. The electronic connector of claim 3, wherein, the magnetic element surrounds the first extending part, and a front end surface of the magnetic element abuts against the base body and a rear end surface of the magnetic element is more closer to the base body than that of the first extending part, so that a receiving groove is formed by the magnetic element incorporated with the first extending part and the shell.

5. The electronic connector of claim 4, wherein, a rear end surface of the shell is flush with the front surface of the first extending part.

6. The electronic connector of claim 3, wherein, the first extending part includes a plurality of first terminal grooves formed on an upper side thereof for receiving the first terminals, a plurality of second terminal grooves formed on a lower side thereof for receiving the second terminals, and an insulated plate formed between the first terminal grooves and the second terminal grooves for separating the first terminal grooves and the second terminal grooves; the first terminal grooves and the second terminal grooves are communicated with the receptacle space.

7. The electronic connector of claim 6, wherein, each of the first terminals comprises a first contact portion, a first fixing portion, a first connecting portion connected between the first contact portion and the first fixing portion, and a first extending portion extending from the first fixing portion in a direction opposite to the first contact portion; the first connecting portion has a wavy shape;

each of the second terminals comprises a second contact portion, a second fixing portion, a second connecting portion connected between the second contact portion and the second fixing portion and a second extending portion extending from the second fixing portion in a direction opposite to the second contact portion; the second connecting portion has a wavy shape;

the second connecting portion received in the second terminal groove and the corresponding first connecting portion received in the first terminal groove forms a clamp for clamping the insulated plate.

8. A data transmission line, comprising:

a first electronic connector comprising:

a male connector;

a female connector comprising:

a shell;

a supporting element received in the shell, and including an insertion opening and a receptacle space communicated with the insertion opening;

a magnetic element received in the shell and surrounding the supporting element;

a first terminal assembly and a second terminal assembly corresponding to the first terminal assembly received in the supporting element, wherein, the first terminal assembly including a plurality of first terminals, and the second terminal assembly including a plurality of second terminals, each of the first terminal extending into the receptacle space, and each of the second terminal extending into the receptacle space, and the first terminal and the corresponding second terminal forming a clamp for clamping the male connector which is inserted into receptacle space via the insertion opening;

a second electronic connector; and a cable connected between the first electronic connector and the second electronic connector.

9. The data transmission line of claim 8, wherein, the female connector further comprise a PCB received in the shell, the PCB is connected to the first terminals and the second terminals and wires of the cable respectively.

10. The data transmission line of claim 8, wherein, the female connector further comprises a fixing element for holding wires of the cable, the fixing element is received in the shell and connected with the supporting element.

11. The data transmission line of claim 10, wherein, the supporting element comprises a base body, a first extending part extending from the base body, and a pair of second extending parts extending from the base body in a direction opposite to the first extending part; the insertion opening is defined in a rear end surface of the first extending part and the receptacle space is defined in an inner of the first extending part.

12. The data transmission line of claim 11, wherein, the fixing element includes a pair of second position groove formed in a rear surface of the fixing element for receiving the second extending parts respectively so that the fixing element is fixed to the supporting element.

13. The data transmission line of claim 12, wherein, each of the second extending parts includes a first position groove, and the fixing element further includes a pair of protruding parts, each of the protruding parts formed in the second position groove corresponding to the first position groove so that the protruding part receives in the first position groove.

14. The data transmission line of claim 11, wherein, the magnetic element surrounds the first extending part, and a front end surface of the magnetic element abuts against the base body and a rear end surface of the magnetic element is more closer to the base body than that of the first extending part, so that a receiving groove is formed by the magnetic element incorporated with the first extending part and the shell.

15. The data transmission line of claim 11, wherein, a rear end surface of the shell is flush with the rear end surface of the first extending part.

16. The data transmission line of claim 15, wherein, each of the first terminals comprises a first contact portion, a first fixing portion, a first connecting portion connected between the first contact portion and the first fixing portion, and a first extending portion extending from the first fixing portion in a direction opposite to the first contact portion; the first connecting portion has a wavy shape;

each of the second terminals comprises a second contact portion, a second fixing portion, a second connecting portion connected between the second contact portion and the second fixing portion and a second extending portion extending from the second fixing portion in a direction opposite to the second contact portion; the second connecting portion has a wavy shape;

the second connecting portion received in the second terminal groove and the corresponding first connecting portion received in the first terminal groove forms a clamp for clamping the insulated plate.

17. The data transmission line of claim 11, wherein, the first extending part includes a plurality of first terminal grooves formed on an upper side thereof for receiving the first terminals, a plurality of second terminal grooves formed on a lower side thereof for receiving the second terminal grooves, and an insulated plate formed between the first terminal grooves and the second terminal grooves for separating the first terminal grooves and the second terminal grooves; the first terminal grooves and the second terminal grooves are communicated with the receptacle space.

* * * * *